United States Patent [19]

Dintemann et al.

[11] Patent Number: 4,574,403

[45] Date of Patent: Mar. 11, 1986

[54] URINAL SCREEN AND DEODORANT CAKE HOLDER

[75] Inventors: Ronald J. Dintemann, Valley Cottage, N.Y.; John J. Barlics, Edison, N.J.

[73] Assignee: Compuguide Chemical Corporation, Englewood Cliffs, N.J.

[21] Appl. No.: 552,618

[22] Filed: Nov. 17, 1983

[51] Int. Cl.[4] ..... E03D 13/00

[52] U.S. Cl. ..... 4/309; 4/222

[58] Field of Search ..... 4/222, 309, 292; 239/57, 60

[56] References Cited

U.S. PATENT DOCUMENTS

| | | | |
|---|---|---|---|
| 3,597,772 | 8/1971 | Leavitt et al. | 4/222 |
| 4,103,367 | 8/1978 | Kaufer | 4/222 |
| 4,135,261 | 1/1979 | Uhrman | 4/309 |

*Primary Examiner*—Henry K. Artis

*Attorney, Agent, or Firm*—Omri M. Behr

[57] ABSTRACT

The invention relates to a urinal screen with a figure-eight shaped deodorant cake holder. The figure eight format provides a holder made of minimum material, yet is not inadvertently opened if subjected to small external pressures. The holder is secured in position by means of a lip which is complementary to a securing lip of a base which is integral with the urinal screen.

22 Claims, 3 Drawing Figures

URINAL SCREEN AND DEODORANT CAKE HOLDER

BACKGROUND AND/OR ENVIRONMENT OF THE INVENTION

The invention concerns a urinal screen with a figure-eight, deodorant cake holder which snap-fits onto the screen. Public urinals, owing to their frequent use tend to give off offensive odors and as a matter of convenience are commonly used as litter receptacles. Urinal screens are generally provided to prevent clogging of the drain by litter thrown into the urinal. To combat the offensive odors, deodorant cakes or blocks are placed in urinals which react with urine to release a masking aroma. If merely dropped into a urinal, the deodorant cake, due to its position, may not be contacted by urine and the masking aroma will not be released. Thus, the purpose of the cake is easily defeated. Similarly, flushing the urinal may dislocate a specifically placed deodorant cake.

SUMMARY OF THE INVENTION

The invention entails a urinal screen and a detachable deodorant cake holder. The urinal screen is tri-cornered to fit snugly into the typical urinal, its purpose being to prevent litter from clogging the urinal drain. The screen has a integral figure-eight shaped base portion with an angled securing lip along the base portion perimeter. A figure-eight constructed retaining box has an engaging lip with a complementary angle which engages the securing lip of the screen. With the retaining box attached to the screen, two deodorant cakes are secured within two appropriately dimensioned circular chambers of the figure-eight retaining box over the center of the urinal. To replace deodorant cakes, the narrow portion of the figure-eight retainer box is squeezed by the installer such that the engaging lip is freed from the securing lip and the retainer box detached from the screen. New cakes are placed on the screen base portion and the retainer box is then snapped into place.

It is therefore an object of the present invention to:

(a) provide a two deodorant-cake holder for longer effective odor masking;

(b) realize a deodorant cake holder which secures the cakes to the urinal screen;

(c) yields a screen which aligns supported deodorant cakes in the urinal center;

(d) furnish a deodorant cake holder from a minimum of material; and (e) produce an easily manipulated deodorant cake holder which is snap-fitted to secure the cakes in position.

DETAILED DESCRIPTION OF THE INVENTION

Figure 1:
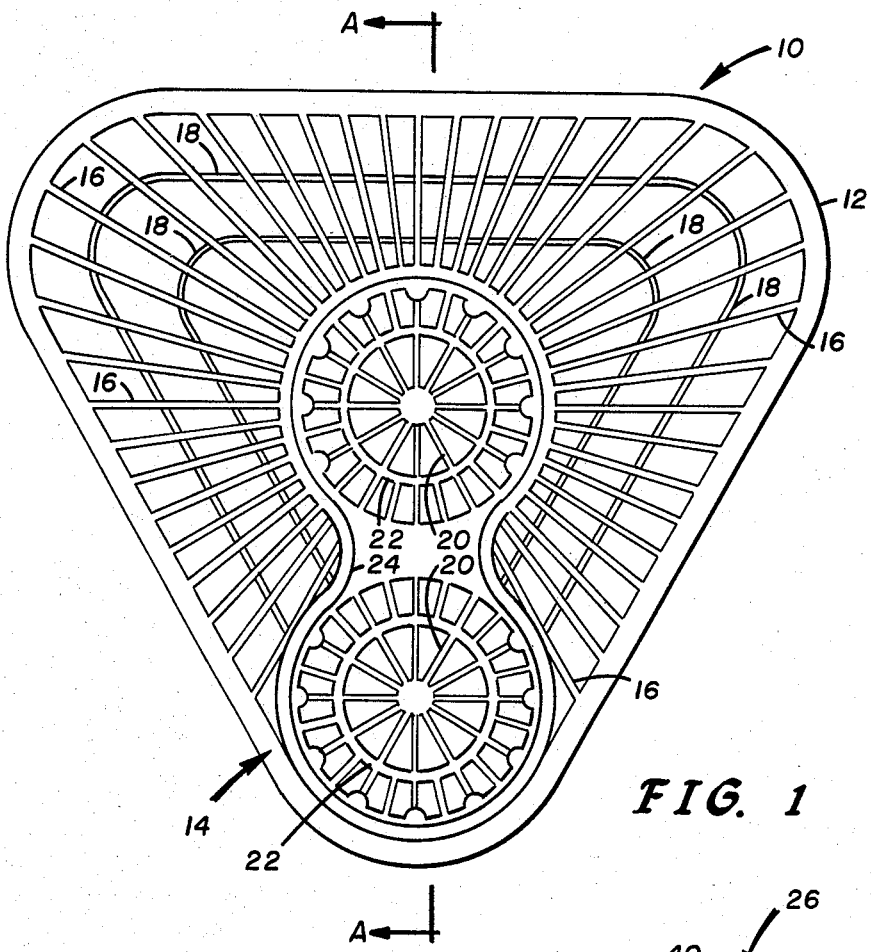
FIG. 1 shows a plan view of the urinal screen.

FIG. 1 shows a urinal screen at 10, according to the present invention, defined by an outer edge 12. The tri-corner shape of the screen 10 insures that the screen 10 fits snugly into the typical urinal in a stationary position. As viewed in FIG. 1, a base portion 14 covers the center and the lower corner of the screen 10, substantially in a figure-eight configuration. The base portion 14, according to the preferred embodiment, is an integral portion of the screen 10 and is connected directly to the outer edge 12 at the lower corner. A set of attaching spokes 16 generate in a radial pattern from the center of the screen 10 to the outer edge 12 except at the lower corner, for additional structural integrity between the base portion 14 and the outer edge 12. To insure proper alignment between the attaching spokes 16, a plurality of spacing members 18 are provided which connect the attaching spokes 16 and parallel the outer edge 12. The base portion 14 comprises two radial grids 20, one of which is positioned in the center of the urinal screen 10 and the other in the lower corner of the screen 10. Circular members 22 are connected to each radial grid 20 for structural support. The attaching spokes 16 and the radial grids 20 are arranged such that they do not inhibit the flow of fluids through the screen 10. The attaching spokes 16 with the spacing members 18 prevent litter from reaching a urinal drain while the radial grids 20 and circular members 22 directly support any deodorant cakes placed thereon. An angled securing lip 24 is attached to the perimeter of the base portion 14 thus having a figure-eight configuration. The function of the securing lip 24 is to secure a retainer box (not shown) to the base portion 14 and is discussed in greater detail with respect to FIG. 3, below.

Figure 2:
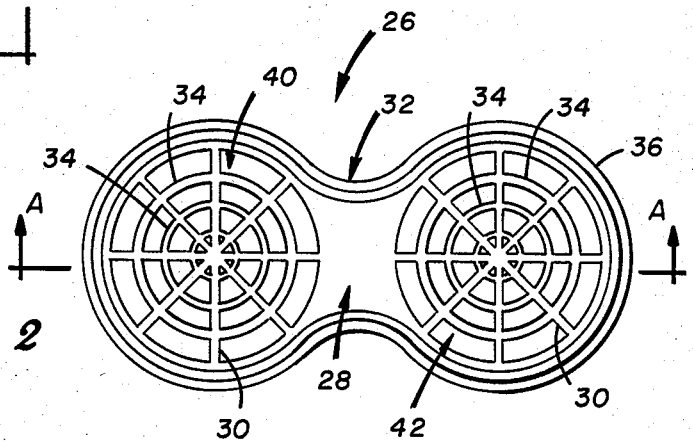
FIG. 2 depicts the figure-eight shaped retainer box in plane view.

FIG. 2 shows the top view of a retainer box 26 having a figure-eight shape which corresponds to that of the base portion 14. This figure-eight configuration provides two chambers 40, 42, which have diameters slightly larger than that of standard deodorant cakes. According to the present invention, the deodorant cakes are enclosed by these chambers 40, 42. As depicted, a face 28 of the retainer box 26 includes two radial grid structures 30. These grid structures 20 are opposite each other and are separated by a narrow section 32 of the retainer box 26. Concentric circular ribs 34 comprise a part of the grid structures 30 and provide support in the manner of circular members 22. An engaging lip 36 follows the contour of the retainer box 26, and as such also has a figure-eight form. The retainer box 26 is secured in position with respect to the base portion 14 by engagement of the securing lip 24 and the engaging lip 36. This aspect is more apparent when explained in congunction with FIG. 3.

Figure 3:
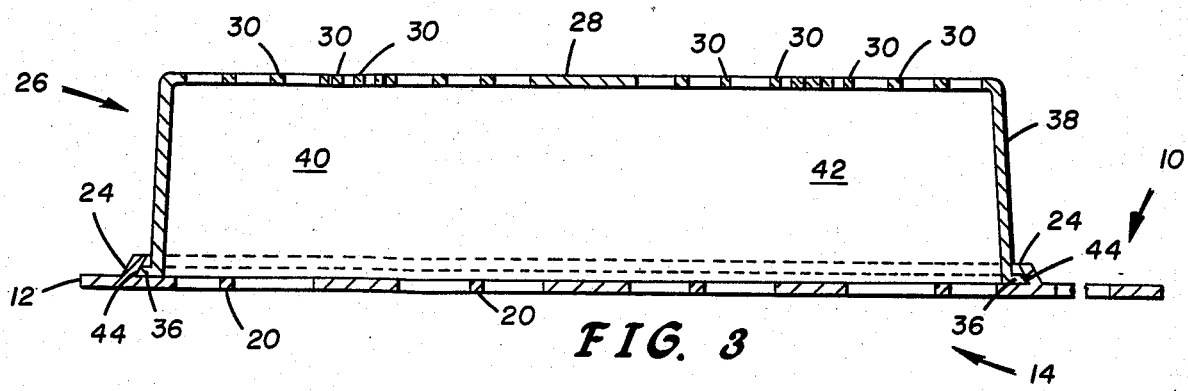
FIG. 3 portrays in expanded cross-section the retainer box as attached to the screen.

FIG. 3 depicts in an expanded, cross-sectional view the relationship of the retainer box 26 with respect to the urinal screen 10, as viewed along the off-center, cut-line A of FIGS. 1 and 2. To install or replace deodorant cakes (not shown), the installer applies an inward pressure to a wall 38, compressing the retainer box 26, which allows separation of the engaging lip 36 from the securing lip 24. The retainer box 26 is removed and one or two deodorant cakes are placed on the base portion 14. The wall 38 is squeezed a second time such that the engaging lip 36 can be snap-fitted inside the securing lip 24. In this manner the deodorant cakes are enclosed and secured by the retainer box 26, one in each chamber 40, 42, upon the base portion 14. As is evident, the wall 38 tapers from the engaging lip 36 toward the face 28 of retainer box 26, at an angle of approximately 3° from vertical.

The engaging lip 36 is provided with an angled edge 44 which is complementary to the angle of the securing lip 24. The preferred embodiment of the invention entails a securing lip 24 at an angle of 60° from the base portion 14, but with a corresponding modification of the engaging lip 36, the angle may range between 0° and 90°. The angle-relationship between the engaging lip 36 and the securing lip 24 allows easy removal of the retaining box 26, yet a means for securely attaching the retainer box 26 to the urinal screen 10 is also realized.

In accordance with the present invention, deodorant cakes are strategically located and are securely maintained in their most effective positions. The chambers 40, 42 by their size and shape minimize the movement of deodorant cakes within the retainer box 26. Similarly, the retainer box 26 movement is restricted due to its attachment via the engagement lip 36/securing lip 24 arrangement to the base portion 14. The base portion 14 does not move with respect to the urinal screen 10 because it is an integral part thereof. The tri-corners of the urinal screen 10 align and anchor the urinal screen 10 within a urinal. Thus, deodorant cakes utilized in the present invention are not inadvertently moved from their central locations.

In terms of production, it would be mechanically simpler to manufacture a rectangular retainer box, however, such a device would tend to pop out from a securing lip upon application of a small force to the long wall of the retainer box. One might suggest that this problem could be avoided if two cylinders were molded into the rectangular retainer box. However, this requires more material to manufacture the retainer box, the amount of which becomes substantial during mass-production. A figure-eight configuration avoids the "pop-out" problem and utilizes a minimum of material.

Other modifications are apparent to one skilled in the art which do not depart from the spirit of the invention. The described embodiment is, therefore, considered to be only illustrative and not restrictive; the scope of the invention being defined by the appended claims. For instance the securing lip 24 need not be attached along the exact perimeter of the base portion 14, but may be somewhat inside the perimeter. The base portion 14 may be a separate piece, not integral to the screen 10. Numerous arrangements of the attaching spokes 16 with the spacing members 18, radial grids 20 with the circular elements 22, and grid structures 30 with the circular ribs 34 are possible.

What is claimed is:

1. A deodorant cake holding device comprising:

a urinal screen having a base portion which is capable of supporting two deodorant cakes:

a securing means attached to said base portion comprising a securing lip and a retainer box of substantially figure-eight shape having a waist portion, capable of holding and separating the said two deodorant cakes and having an engaging lip for engaging said securing lip, said engaging lip being deformable by pressure upon both sides of said waist portion of said retainer box, said box being attached to said base portion via said securing means wherein the securing lip and engaging lips are substantially figure-eight shaped, said retainer box being removable from and replaceable in said securing lip by pressing together the sides of said box at the waist of said figure-eight.

2. A holding device as in claim 1, wherein the securing lip is mounted at an angle relative to the urinal screen and the engaging lip has an edge at an angle complementary to the angle of the securing lip.

3. A holding device as in claim 2, wherein the base portion is figure-eight shaped and is integral to the urinal screen, and wherein the securing lip is attached along the perimeter of the base portion.

4. A holding device as in claim 3, wherein the securing lip angle is less than 90° from the base portion.

5. A holding device as in claim 4, the retaining box comprising:

a wall having two ends, wherein one wall end is connected to the lip; and a face connected to the other wall end, wherein the wall tapers from the engaging lip to the face.

6. A holding device as in claim 5, the urinal screen comprising:

an outer edge; and a plurality of attaching spokes which connect the edge to the base portion.

7. A holding device as in claim 6, wherein the plurality of attaching spokes is arranged in a radial pattern, the urinal screen also comprising at least one spacing member which parallels the outer edge and is connected to each of the plurality of attaching spokes.

8. A holding device as in claim 7, the base portion having at least one radial grid which supports the at least one deodorant cake.

9. A holding device as in claim 8, the base portion also having a circular element connected to structurally support the radial grid.

10. A holding device as in claim 9, the retaining box face having at least one grid structure.

11. A holding device as in claim 10, the retaining box face having at lease one circular rib connected to support the grid structure.

12. A deodorant cake holding device comprising:

a base portion which supports at least one deodorant cake;

a securing means attached to the base portion; and a retainer box for holding the at least one deodorant cake, attached to the loose portion via the securing means.

13. A holding device as in claim 12, the securing means comprising a securing lip, and wherein the retainer box has an engaging lip which engages the securing lip.

14. A holding device as in claim 13, wherein the securing lip, retainer box, and engaging lip are substantially figure-eight shaped.

15. A holding device as in claim 14, wherein the securing lip is mounted at an angle relative to the base portion and the engaging lip has an edge at an angle complementary to the angle of the securing lip.

16. A holding device as in claim 15, wherein the base portion is figure-eight shaped and the securing lip is attached along the perimeter of the base portion.

17. A holding device as in claim 16, wherein the securing lip angle is less than 90° from the base portion.

18. A holding device as in claim 17, the retaining box comprising:

a wall having two ends, wherein one wall end is connected to the engaging lip; and a face connected to the other wall end, wherein the wall tapers from the engaging lip to the face.

19. A holding device as in claim 18, the base portion having at least one radial grid which supports the at least one deodorant cake.

20. A holding device as in claim 19, the base portion also having a circular element connected to structurally support the radial grid.

21. A holding device as in claim 20, the retaining box face having at least one grid structure.

22. A holding device as in claim 21, the retaining box face having at least one circular rib connected to support the grid structure.

* * * * *